US006443645B1

(12) United States Patent
Takei et al.

(10) Patent No.: US 6,443,645 B1
(45) Date of Patent: Sep. 3, 2002

(54) PRINTER WITH CUTTER BLADES FOR PRINTING ON ROLLED PAPER AND SLIPSHEET

(75) Inventors: Yoshiki Takei; Yutaka Akahori, both of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 3 days.

(21) Appl. No.: 09/785,540

(22) Filed: Feb. 20, 2001

(51) Int. Cl.[7] ..... B41J 11/70; B41J 11/00; B41J 13/10; B41J 29/02; B41J 29/13

(52) U.S. Cl. ..... 400/621; 400/691; 400/595; 400/599; 400/605; 400/607; 400/607.2

(58) Field of Search ..... 400/621, 691, 400/693, 124.08, 595, 599, 605, 607, 607.2

(56) References Cited

U.S. PATENT DOCUMENTS

| | | | | |
|---|---|---|---|---|
| 5,044,801 A | * | 9/1991 | Uchimura et al. | 400/692 |
| 5,579,043 A | * | 11/1996 | Patry | 347/222 |
| 5,779,371 A | * | 7/1998 | Aoyama et al. | 106/272 |
| 5,927,878 A | * | 7/1999 | Kasai et al. | 400/691 |
| 6,030,133 A | * | 2/2000 | Endo | 400/605 |

FOREIGN PATENT DOCUMENTS

| | | |
|---|---|---|
| EP | 0 811 502 | 12/1997 |
| JP | 60-16400 | 1/1985 |
| JP | 62-44395 | 2/1987 |
| JP | 2-111552 | 4/1990 |
| JP | 7-195297 | 8/1995 |

* cited by examiner

*Primary Examiner*—Daniel J. Colilla
(74) *Attorney, Agent, or Firm*—Nixon & Vanderhye P.C.

(57) ABSTRACT

A cabinet is formed on the top face with an entry opening for rolled paper, and a storage section for accommodating the rolled paper. A cover is provided for opening/closing the entry opening, and the upper front of the cover is provided as a slipsheet entry face for inserting a slipsheet. The slipsheet entry face is formed in one side margin with a slipsheet guide along the insertion direction of the slipsheet. A paper discharge slot of the rolled paper is formed by a gap between a buff portion of the cabinet and the tip of the cover, when the cover is closed. The paper discharge slot is at a position lower than that of the slipsheet entry face. A slipsheet print section is placed on the upper rear portion of the cover.

29 Claims, 14 Drawing Sheets

PRINTER WITH CUTTER BLADES FOR PRINTING ON ROLLED PAPER AND SLIPSHEET

BACKGROUND OF THE INVENTION

The present invention relates to a printer capable of printing on both continuous paper and a slipsheet.

A printer for printing on continuous paper used for receipts, tickets, or other issued tickets and a printer for printing on slipsheets used for personal check forms, etc., are used widely. Particularly, in recent years, a printer which comprises a print function of continuous paper and a print function of slipsheets and can print on both continuous paper and a slipsheet in a single unit has also been used.

FIG. 17 is an external perspective view of a printer in a related art capable of printing on both continuous paper and a slipsheet. A printer 100 shown in the figure comprises, on the front, a slipsheet entry face 101 and a slipsheet print section 102 for printing on a slipsheet S inserted into the slipsheet entry face 101. The printer 100 also comprises, on the rear, a rolled-paper storage section (not shown) for storing rolled paper, a rolled-paper print section 103 for printing on the rolled paper, and a paper discharge slot 104 for discharging a printed portion of the rolled paper.

However, if the slipsheet print mechanism is placed on the front and the rolled-paper print mechanism is placed on the rear. like in the related art printer, it may be hard to take the rolled paper from the paper discharge slot on the rear of the printer depending on where the printer is installed. To facilitate inserting a slipsheet, the depth of the slipsheet entry face preferably is made wide. In doing so, however, the full length of the printer is increased, running counter to the demand for miniaturization.

SUMMARY OF THE INVENTION

It is therefore an object of the present invention to provide a printer for printing on both continuous paper and a slipsheet, wherein it is possible both to easily take out discharged continuous paper and to provide a long slipsheet entry face.

In order to achieve the above and other objects, there is provided a printer, for printing on both continuous paper and a slipsheet, comprising:

a cabinet for accommodating the continuous paper which is entered from an entry opening provided in a top face of the cabinet;

a first print section, provided in the cabinet, for printing on the accommodated continuous paper;

a cover having a rear end portion, said rear end portion is pivotably supported by the cabinet so that the cover opens/closes the entry opening;

a discharge slot defined between the cabinet and a front end portion of the cover when the cover is closed, wherein the discharge slot is adapted to discharge the continuous paper from the printer;

an entry face provided as a front top face of the cover, to which the slipsheet is inserted; and a second print section provided in an upper rear portion of the cover, wherein the second print section is adapted to print the slipsheet inserted in the entry face.

In this configuration, since the paper discharge slot can be formed ahead of the slipsheet entry face, the discharged continuous paper can be easily taken out. Further, since the slipsheet is inserted to the front top face of the cover, the slipsheet entry face can be made long.

Preferably, the discharge port is placed at a position lower than the entry face. In this case, the slipsheet can be inserted or discharged without being blocked by the discharge slot. If the slipsheet has a size extending off the entry face and reaching the discharge slot, its flatness can be maintained and thus the print operation is not hindered.

Preferably, the printer further includes a guide member provided in either the cover or the cabinet, for defining a widthwise position of the slipsheet. In this case, the position of the slipsheet in the widthwise direction thereof can be determined and a print shift, etc., can be prevented.

Preferably, the printer further includes a buffer member for buffering against the closing movement of the cover due to the weight thereof. In this case, the cover can be prevented from being closed.

Preferably, the printer further includes: a cover state detector for detecting whether the cover is opened; and a controller for disabling printing on the slipsheet when the cover state detector detects that the cover is opened. If the cover is opened even a little, the entry face cannot be held horizontal and the print operation may be hindered. Thus, if the cover is open, printing on the slipsheet is disabled, whereby the print operation can be prevented from being hindered.

According to the invention, there is also provided a printer, for printing on continuous paper, comprising:

a cabinet provided with an entry opening through which the continuous paper may be entered into the cabinet;

a first print section, provided in the cabinet, for printing on the continuous paper;

a cover pivotably supported at a first position of the cabinet so as to open/close the entry opening;

a frame member supported at a second position of the cabinet and connected to the cover so as to be movable thereon;

a discharge slot, defined between one end portion of the cover and the cabinet when the cover is closed, through which the continuous paper may be discharged from the printer; and a first cutter blade supported by the frame member and situated so as to cut the continuous paper at the discharge slot when the cover is closed, wherein a distance between the end portion of the cover and a blade edge of the first cutter blade when the cover is opened is larger than a distance therebetween when the cover is closed.

In this configuration, when the cover is opened, the blade edge of the first cutter blade is moved to a position away from the tip of the cover, and the end portion of the cover can prevent the operator from touching the edge of the cutter blade. Therefore, it is possible to perform work more easily and safely when the cover is opened.

Alternatively, the printer may be configured so that a distance between a back face of the cover and a blade edge of the first cutter blade, when the cover is closed, is larger than a distance therebetween when the cover is opened.

In this configuration, when the cover is opened, the edge of the first cutter blade is brought close to the back face of the cover, and the cover can prevent the operator from touching the tip of the cutter blade. Therefore, it is possible to perform work more easily and safely when the cover is opened.

Alternatively, the printer may be configured so that a blade edge of the first cutter blade is housed in the cover when the cover is opened.

In this configuration, the cover can prevent the operator from touching the tip of the cutter blade. Therefore, it is possible to perform work more easily and safely when the cover is opened.

Preferably, the printer further includes a second cutter blade, provided in the cabinet, which is to be crossed with the first cutter blade to cut the continuous paper when the cover is closed. In this configuration, when the cover is opened, the first cutter blade held on the cover is protected, and it is also possible to maintain the performance of the cutter.

Preferably, the printer further includes a driver, provided in the cabinet, for moving the second cutter blade so as to cross with the first cutter blade.

In this configuration, the first cutter blade in the cover can be simplified, thereby the weight of the cover can be reduced and ease of use can be improved.

Preferably, the printer further includes a connecting member for connecting the cover and the frame member so that they are movable with respect to each other.

In this configuration, since a truss structure can be formed among the cover, the connecting member, and the cabinet, it is possible to enhance the torsional rigidity of the cover when it is in an open state. Therefore, the cover can be opened more smoothly.

Preferably, the connecting member includes a slot provided in one of the cover and the frame member, and a support shaft provided in the other so as to be slidable within the slot.

In this configuration, the connecting member further enhances the rigidity of the cover member.

Preferably, the printer further comprises a platen supported by the frame member. The continuous paper is sandwiched between the platen and the first print head.

In this configuration, it is harder for the operator to touch the first cutter blade. Thus, the operator can work more safely when the cover is opened.

Preferably, a pivotal path of the first cutter blade is situated more inward than is a pivotal path of the end portion of the cover.

In this configuration, when the cover is opened, the first cutter blade can be retreated from the position thereof when the cover is closed, thereby the operator can work more safely when the cover is opened.

Preferably, the printer further includes a second print head provided in the cover, for printing on a slipsheet.

In this configuration, since the second print head, mounted on the cover, is supported by the cover and the frame member having the different rotation shafts, it is possible to operate the cover more smoothly.

BRIEF DESCRIPTION OF THE DRAWINGS

The above and other objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Figure 1:
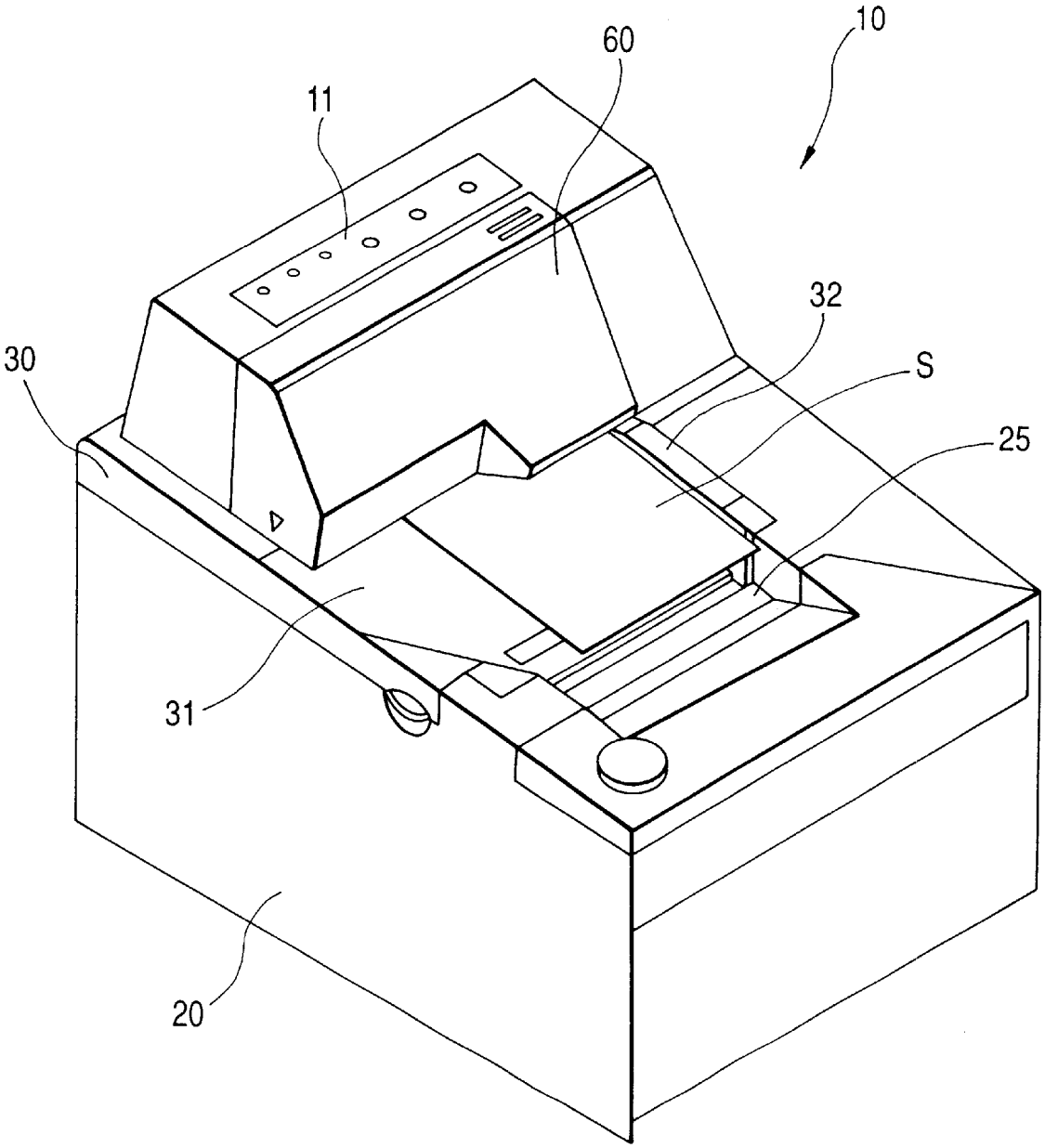
FIG. 1 is an external perspective view of a printer according to a first embodiment of the invention when its cover is closed.
Figure 2:
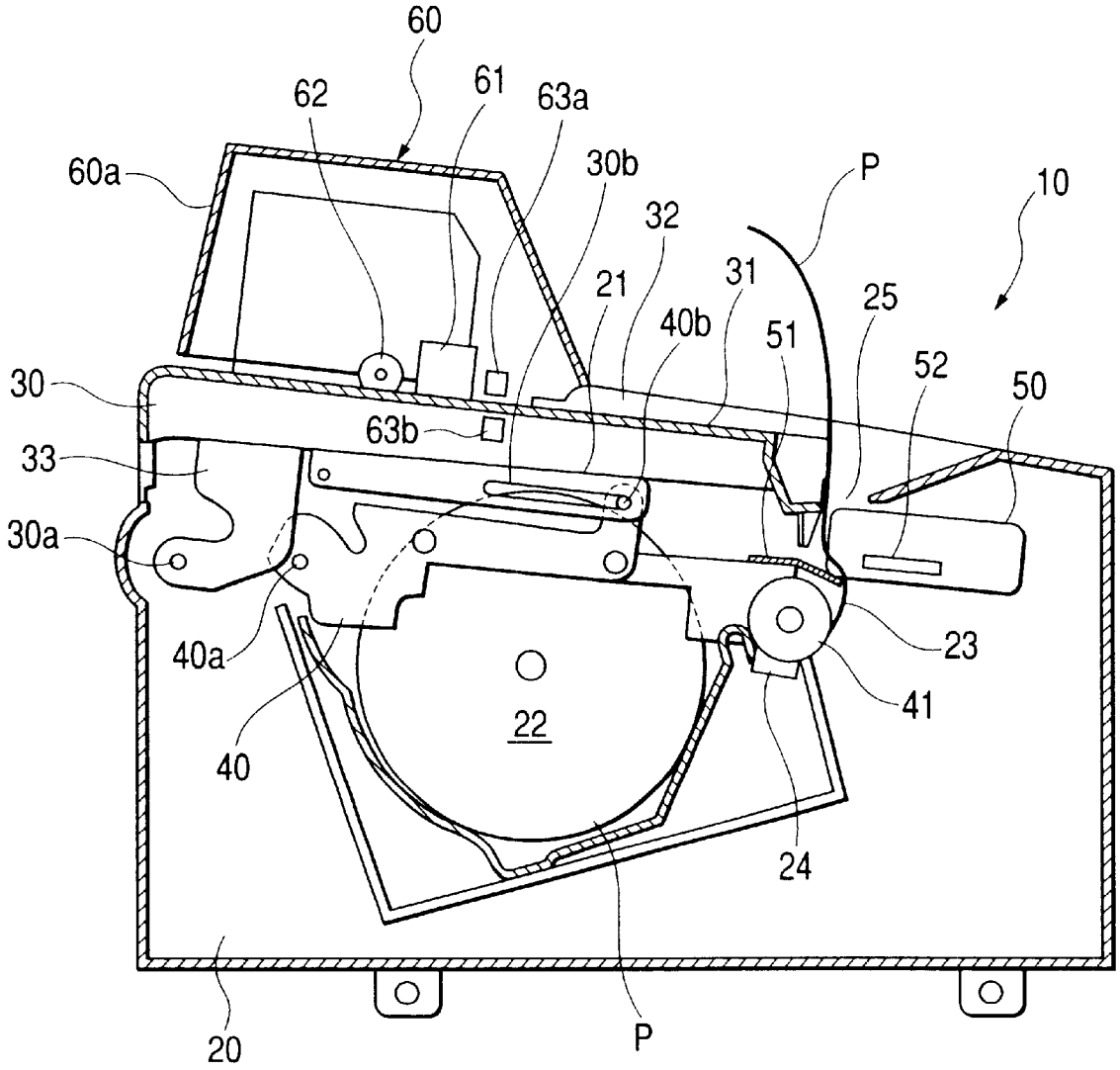
FIG. 2 is a sectional side view of the printer according to the first embodiment of the invention when its cover is closed.

Referring now to the accompanying drawings, there are shown preferred embodiments of the invention. FIGS. 1 and 2 are drawings to show a printer according to a first embodiment of the invention when a cover is closed; FIG. 1 is an external perspective view and FIG. 2 is a sectional side view.

A printer 10 shown in FIGS. 1 and 2 is a printer capable of printing on both rolled paper and a slipsheet. The printer 10 generally includes a cabinet 20 for storing rolled paper, a cover 30, arm members 40, and a slipsheet print section 60. The cabinet 20 includes a print mechanism for printing on the rolled paper and the like. The cover 30 covers the top face of the cabinet 20,, whereas the arm members 40 include a cutter for cutting the rolled paper. And the slipsheet print section 60 is for printing on an inserted slipsheet.

As shown in FIGS. 1 and 2, the cabinet 20 of the printer 10 is formed on its top face with an entry opening 21 for inserting rolled paper P, and contains a storage section 22 for holding the rolled paper P. The rolled paper P is rotatably held in the storage section 22 and has one end drawn out to the front of the cabinet 20 after having passed through a transport passage 23 formed when the cover 30 is closed. A thermal print head 24 is installed in the transport passage 23 for printing on the rolled paper P in accordance with a print instruction received from a host computer.

A paper discharge slot 25 is formed by a gap defined at a butt portion of the cabinet 20 and the tip of the cover 30, when the cover 30 is closed. The paper discharge slot 25 is at a position lower than that of a slipsheet entry face 31 (described later) and does not project onto the extension of the slipsheet entry face 31. The end of the rolled paper P that was printed by the print head 24 passes through the transport passage 23 and is drawn out through the paper discharge slot 25 to the outside of the printer. The printer 10 also includes a cutter mechanism 50 downstream from the print head 24, namely, inside the paper discharge slot 25, to cut and separate the printed portion from the rolled paper P stored in the cabinet. Basically, the cutter mechanism 50 is made up of a blade pair—having a fixed blade 51 and a moving blade 52—and a drive section (not shown) for driving the moving blade 52 when the rolled paper P is cut. The fixed blade 51 is fixed to the arm members 40, described later, and the moving blade 52 is fixed to the cabinet 20. The end of the rolled paper P that is drawn out from the storage section 22, and is printed upon by the print head 24, passes through the gap between the fixed blade 51 and the moving blade 52 and then exits from the paper discharge slot 25. The fixed blade 51 and the moving blade 52 are placed so that they cross each other while coming in sliding contact with each other like a pair of scissors; the rolled paper P placed between the blades is cut by both blades as the moving blade 52 is closed.

The printer cover 30 opens and closes the entry opening 21 formed in the top face of the cabinet 20. The upper front of the cover 30 is the slipsheet entry face 31, for inserting a slipsheet S to print on it. The slipsheet entry face 31 is a flat face and becomes an almost horizontal face when the cover 30 is closed. Further, the slipsheet entry face 31 is formed in one side margin with a slipsheet guide 32 along the insertion direction of the slipsheet S. Thus, a side margin of the slipsheet S, when placed on the slipsheet entry face 31, is abutted against the slipsheet guide 32, whereby the position of the slipsheet S in the width direction thereof is determined. The cover 30 is connected to the cabinet 20 by a connection frame 33 placed on its rear for rotation (see also FIG. 15).

Figure 16:
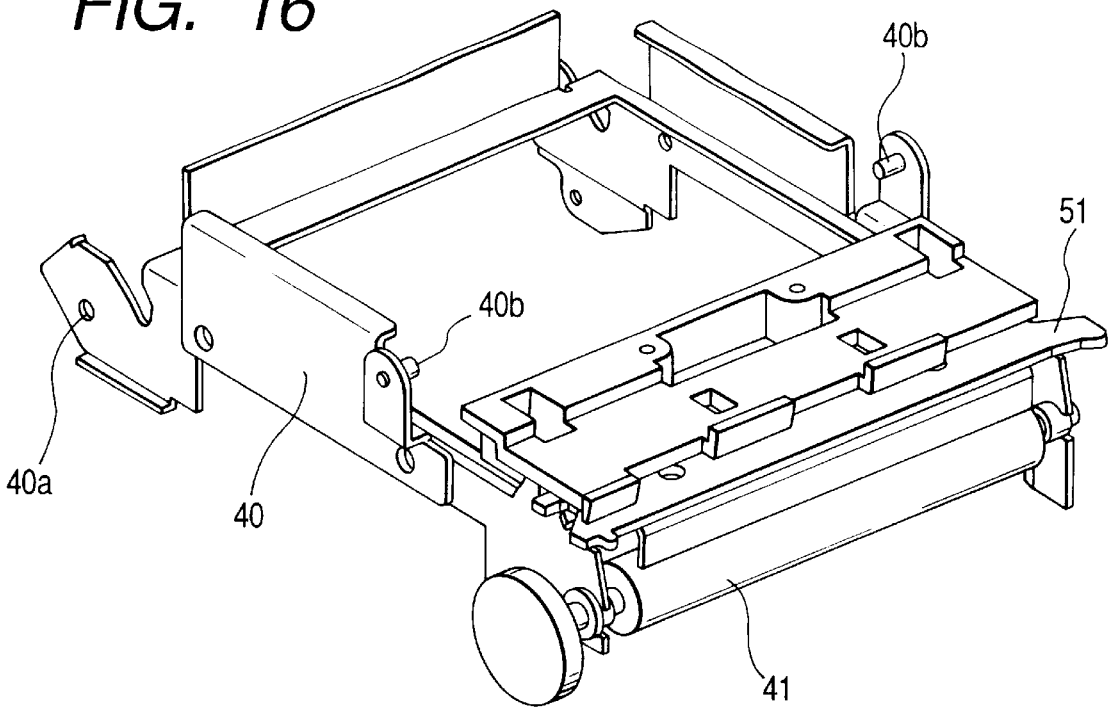
FIG. 16 is a fragmentary perspective view of the printer according to the embodiments of the invention.
Figure 17:
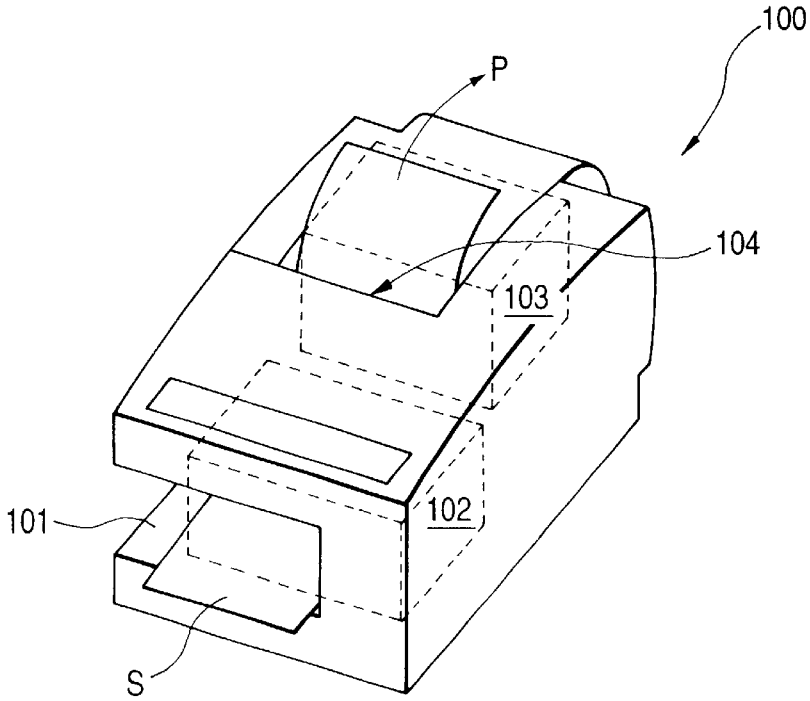
FIG. 17 is an external perspective view of a related art printer capable of printing on both continuous paper and a slipsheet.

FIG. 16 shows the printer's pair of arm members 40 on the back of the cover 30. Placed at the tips of the arm members 40 are the fixed blade 51, which is fixed so that it projects forward, and a platen 41 that is opposed to the print head 24 when the cover 30 is closed. The arm members 40 are connected at the rear ends to the cabinet 20 for rotation. The arm members 40 will be described later in detail. As shown in FIG. 2, when the cover 30 is closed, the arm members 40 are placed inside the cabinet 20 so that the fixed blade 51, at the tips of the arm members 40, is slightly exposed from the tip of the cover 30.

The slipsheet print section 60 is placed on the rear of the top of the cover 30. The slipsheet print section 60 comprises a print head 61, and a transport roller 62, in a cover 60*a* for printing on the slipsheet S inserted onto the slipsheet entry face 31. The print head 61 is of the cylinder type, and contains dot pins arranged at predetermined intervals in parallel in the width direction of the slipsheet S. At printing time, in accordance with a print instruction received from the host computer, the print head 61 moves at strokes of the dot pin intervals in the width direction of the slipsheet S, and the slipsheet S is fed in the feed direction by the transport roller 62, whereby two-dimensional printing is provided on the slipsheet S. After terminating the printing, the transport roller 62 is fed backward, whereby the slipsheet S is returned to the slipsheet entry face 31.

A switch panel 11, comprising switches operated by the operator, is placed on the top of the cover 61*a*. The switches include a switch for changing the printer mode between online and offline, paper feed switches for slipsheets and roll paper, and the like, for example. The switches are operated in predetermined combinations, whereby various test print modes can be set.

A slipsheet detector 63 is disposed before the slipsheet print head 61. In the example, the slipsheet detector 63 uses a transmission-type photosensor having a light emitting section 63*b* and a light receiving section 63*a*. Any sensor such as a reflection-type photosensor or a limit switch can be used as the slipsheet detector 63.

Figure 3:
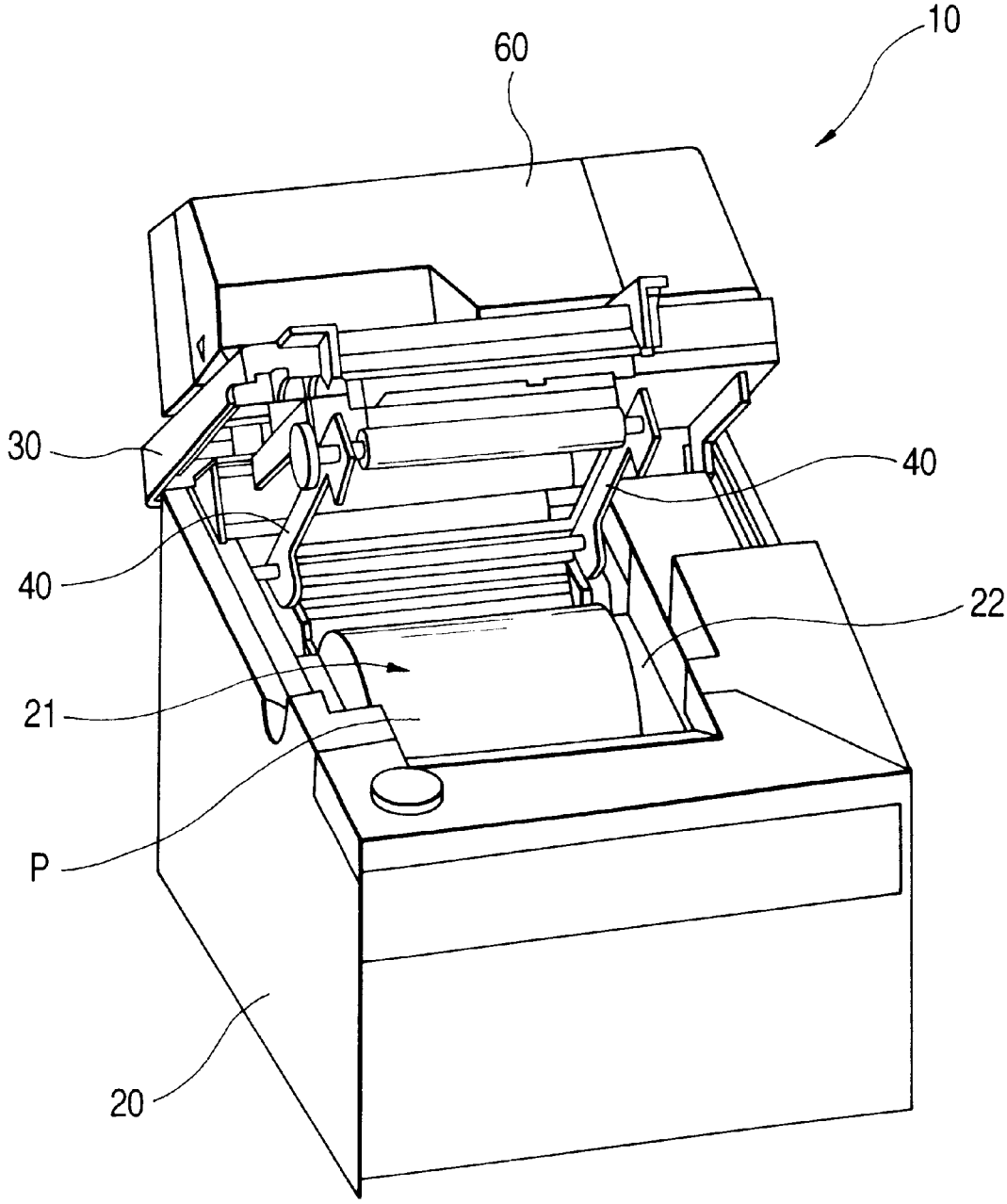
FIG. 3 is an external perspective view of the printer according to the first embodiment of the invention when its cover is opened.
Figure 4:
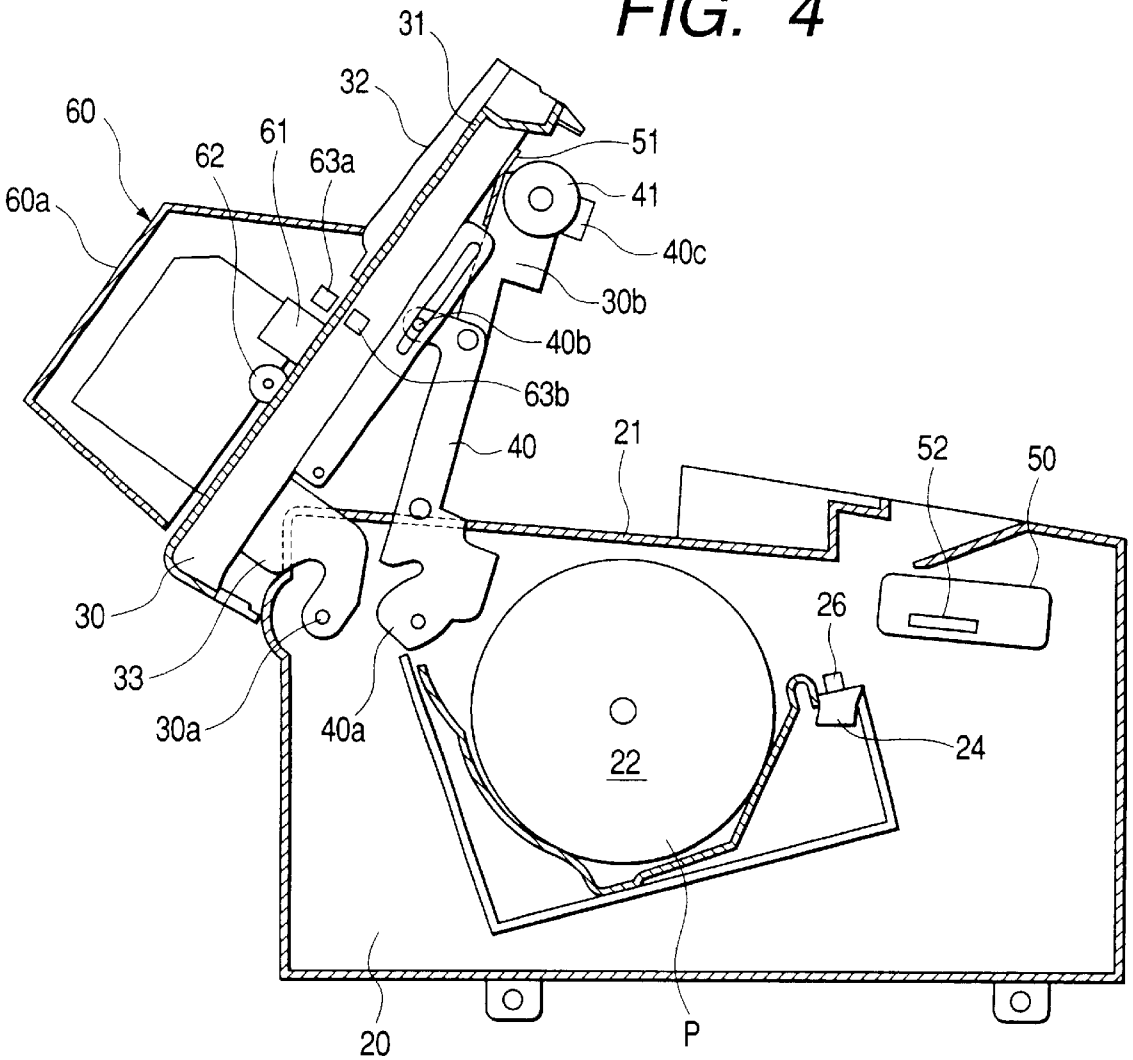
FIG. 4 is a sectional side view of the printer according to the first embodiment of the invention when its cover is opened.

FIGS. 3 and 4 are drawings showing the printer when the cover is open; FIG. 3 is an external perspective view and FIG. 4 is a sectional side view. As shown in the figures, the cover 30 can be opened upward in FIG. 3 with a fulcrum 30*a* formed on the connection frame 33 as a shaft relative to the cabinet 20. The cover 30 is opened, whereby it is made possible to perform replacement of the rolled paper P, maintenance and inspection of the printer inside, and the like.

The cover 30 is urged so that it is slightly opened by an urging member such as a spring, etc., (not shown) placed in the proximity of the print head 24 in the cabinet 20. If the user unlocks the cover 30 of the cabinet 20 by pressing an open switch of the cover 30 (not shown), the cover 30 is slightly lifted up by the urging force.

The open or closed state of the cover 30 is detected by a cover state detector composed of a transmission-type photosensor 26, and a detected projection 40*c* formed on the arm member 40 and which is detected by the photosensor 26. That is, when the cover 30 is closed, the detected projection 40*c* blocks the optical path of the photosensor 26; when the cover 30 is open, the detected projection 40*c* does not block the optical path. The transmission-type photosensor can be replaced with any other sensor, such as a reflection-type photosensor, a limit switch, a lead switch, or the like. The arm member 40 can be rotated upward in FIG. 3 with a fulcrum 40*a* at the rear end as a shaft relative to the cabinet 20. The fulcrum 40*a* of the arm member 40 is positioned forward—in the back and forth direction of the cabinet 20—with respect to the fulcrum 30*a* of the cover 30. A support shaft 40*b* is formed in the proximity of the middle of the arm member 40, in the length direction thereof. Made in the the cover 30 is a slot 30*b* shaped parallel with the slipsheet entry face 31. The support shaft 40*b* of the arm member 40 can slide in the slot 30*b* made in the cover 30. When the cover 30 is closed, the support shaft 40*b* is positioned at the tip of the cover 30; when the cover 30 is opened completely, the support shaft 40*b* is positioned at the rear end of the cover 30.

The cover 30 and the arm member 40 are joined in a mutually slidable manner by the slot 30*b* and the support shaft 40*b*, whereby the s rotation operation of each arm member 40 can be associated with the opening/closing operation of the cover 30. Thus, when the cover 30 is opened, at the same time, the arm members 40 are rotated. Additionally, by such opening action, the fixed blade 51 and the platen 41 can be lifted up.

Thus, the cover 30 (that can be opened and closed with the fulcrum 30*a* as the shaft) and each arm member 40 (that can be rotated with another fulcrum 40*a* as the shaft) are joined in a mutually slidable manner by the slot 30*b* and the support shaft 40*b,* and the rotation operation of each arm member 40 is associated with the opening/closing operation of the cover 30, whereby the relative position of the fixed blade 51 to tip of the cover 30 can be changed.

That is, as shown in FIG. 2, when the cover 30 is closed, the fixed blade 51, which is fixed to the tips of the arm members 40, is slightly exposed from the tip of the cover 30. In contrast, as shown in FIG. 4, when the cover 30 is opened, the arm members 40 are pulled up in association with the opening operation of the cover 30, and the fixed blade 51 is moved in the direction toward the rear end of the cover 30. The fixed blade 50 moves toward the rear end of the cover 30 because of the rotation fulcrum shift of each arm member 40 and the cover 30 which moves it in the direction toward the back of the cover 30, i.e., so that it is retreated to the back of the cover 30.

As described above, in the printer 10, the fixed blade 51 is fixed to the tips of the arm members 40, and the cover 30 and each arm member 40 are rotated on different fulcrums, so that when the cover 30 is closed, the fixed blade 51 is exposed from the tip of the cover 30; when the cover 30 is opened, the fixed blade 51 is retreated to the back of the cover 30. Thus, unlike the related art printer with the cutter fixed to the tip of the cabinet, the cutter is not exposed when the cover is opened. Therefore, special care need not be taken for the cutter and it is possible to easily perform replacement of rolled paper, maintenance and inspection of the printer's inside, and the like.

Although the printer 10 comprises the arm members 40, the rotation of the arm members 40 is associated with the opening/closing operation of the cover 30, so that to perform replacement of rolled paper, maintenance and inspection of the printer's inside, or the like, the cover 30 needs only to be opened and closed as in the related printer, and it is not necessary to separately rotate the arm members 40 thereby making the work uncomplicated.

As described above, in the printer 10, the paper discharge slot 25 of the rolled paper P is formed by the gap of the butt portion of the cabinet 20 and the tip of the cover 30, when the cover 30 is closed. The upper front of the cover 30 is the slipsheet entry face 31, and the slipsheet print section 60 is placed on the upper rear of the cover 30.

Therefore, the paper discharge slot 25 is positioned at the front of the printer 10. Thus, as compared with the structure of the related art printer—wherein the paper discharge slot is positioned at the rear of the printer, for example, if the printer is installed at a high position and the user extends an arm to the end of rolled paper discharged from the paper discharge slot, and takes out the end of the rolled paper—the user can easily take out the paper end. Further, since the slipsheet print section 60 is placed on the rear of the cover 30, there can be provided the slipsheet entry face 31 having larger depth.

Further, in the printer 10, the paper discharge slot 25 is at a position lower than that of the slipsheet entry face 31, and does not project onto the extension of the slipsheet entry face 31. Thus, the slipsheet S can be inserted or discharged without being blocked by the paper discharge slot 25. Even if the slipsheet S has a size extending off the slipsheet entry face 31, and reaching the paper discharge slot 25, its flatness can be maintained whereby the print operation is not hindered.

By the way, if the cover 30 is opened, it may be rotated naturally in the closed direction under its own weight. Particularly, in the printer 10, the slipsheet print section 60 is placed on the top of the cover 30 and, thus, the cover 30 is easily rotated in the closed direction under its own weight and that of the slipsheet print section 60. In such a case, working with the cover open becomes troublesome and, thus, preferably a buffer is provided against the rotation of the cover 30 in the closed direction.

Figure 5:
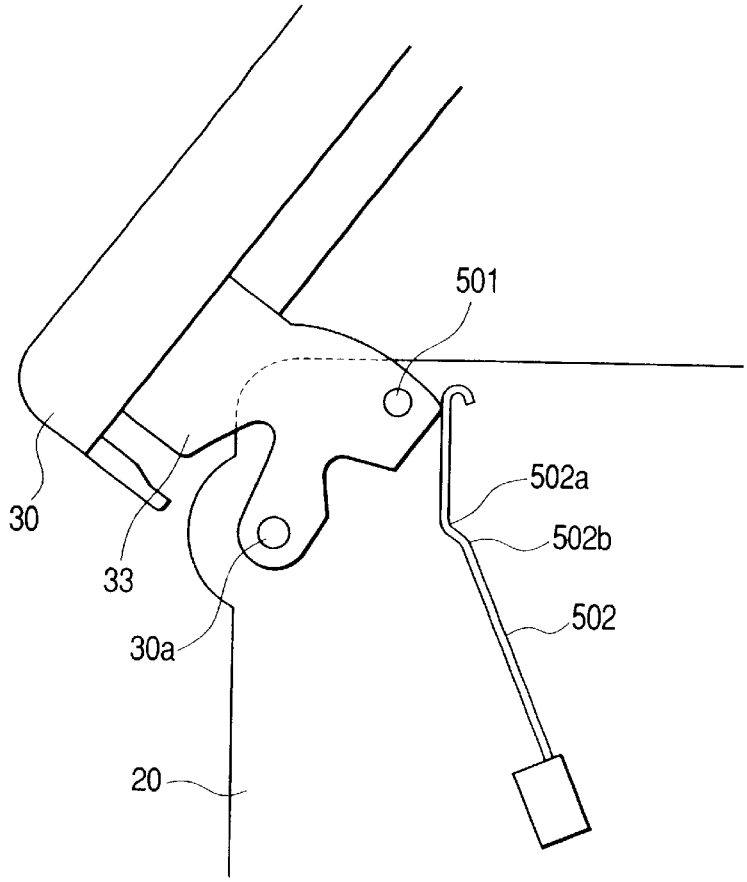
FIG. 5 is a drawing to describe the motion of a structure for providing a buffer against the rotation of the cover in the closed direction, showing a state in which the cover is completely opened.
Figure 6:
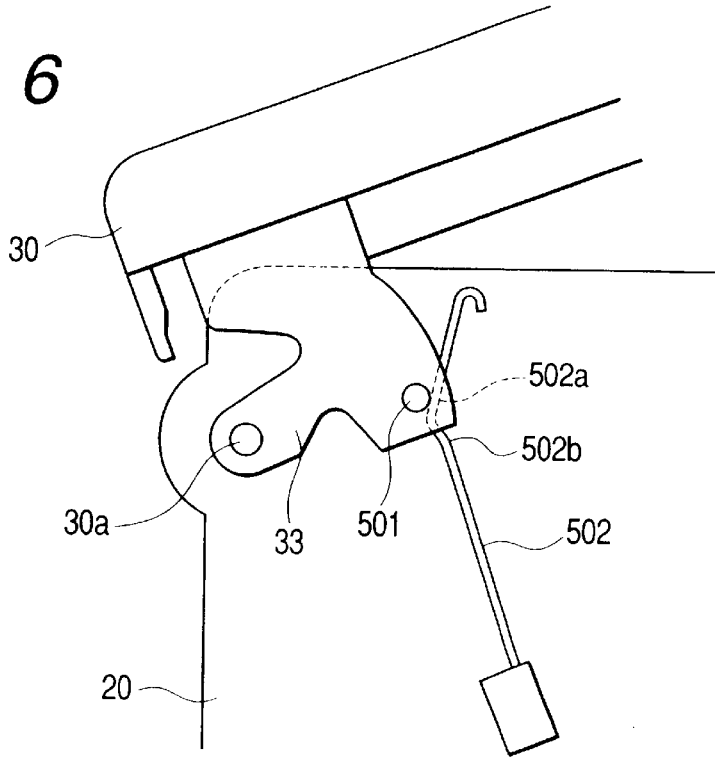
FIG. 6 is a drawing to describe the motion of the structure for providing the buffer, showing a state in which the cover is partially closed.
Figure 7:
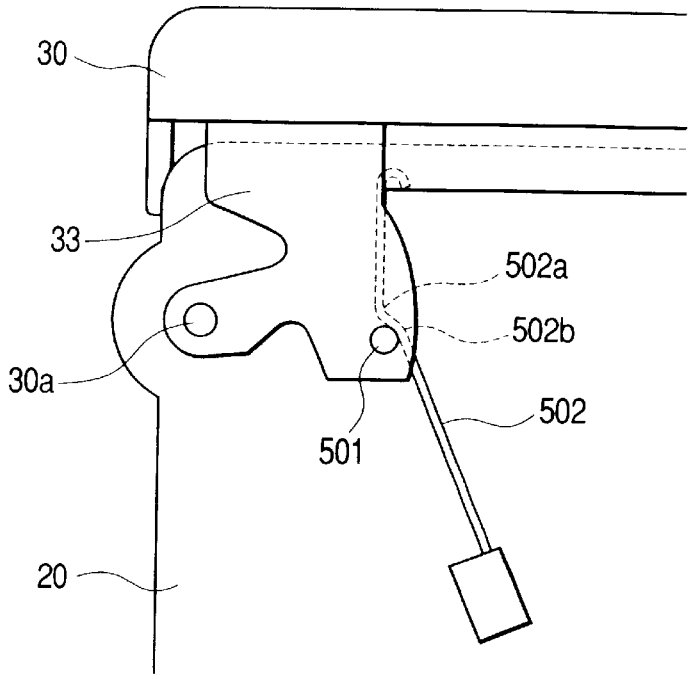
FIG. 7 is a drawing to describe the motion of the structure for providing buffer, showing a state in which the cover is completely closed.

FIGS. 5 to 7 are drawings describing the motion of a structure for providing a buffer against the rotation of the cover 30 in the closed direction. FIG. 5 shows a state in which the cover is completely opened, FIG. 6 shows a state in which the cover is partially closed, and FIG. 7 shows a state in which the cover is closed completely.

As shown in FIG. 5, a pin 501 is placed on the connection frame 33, which is connected to the rear end of the cover 30. A plate spring 502 is placed on the cabinet 20. The plate spring 502 is bent at bend points 502*a* and 502*b,* and is fixed at an end to the cabinet 20.

As shown in FIG. 5, if the cover 30 is opened completely, the pin 501 and the plate spring 502 are away from each other. However, as the cover 30 is rotated gradually in the closed direction under its own weight and that of the slipsheet print section 60, the pin 501 is gradually brought close to the plate spring 502. When the open angle of the cover 30 becomes a predetermined angle, the pin 501 abuts on the plate spring 502.

Then, after the pin 501 abuts on the plate spring 502, the cover 30 is further rotated in the closed direction under its own weight and that of the slipsheet print section 60. Thus, the pin 501 slides to the end of the plate spring 502 while pressing the plate spring 502 forward. On the other hand, as the plate spring 502 is pressed increasingly forward, the force of pressing the pin 501 backward, namely, the buffering force of the spring 502 against the rotation of the cover 30 in the closed direction is increased gradually. When the force attempting to rotate the cover 30 in the closed direction under its own weight and that of the buffering force against the rotation of the cover 30 in the closed direction are balanced, the cover 30 stands still, as shown in FIG. 6.

Then, if the user presses the top face of the cover 30, the cover 30 is further rotated in the closed direction by the user's press force. Thus, further the pin 501 slides to the end of the plate spring 502 while forwardly pressing the plate spring 502, so that the position of the pin 501 exceeds the bend point 502*a*. When the pin 501 exceeds the bend point 502*a,* the bias force on the plate spring 502 is released. As shown in FIG. 7, when the cover 30 is closed completely, the pin 501 abuts on a point between the bend points 502*a* and 502*b* of the plate spring 502 and stands still.

Thus, the pin 501 is placed on the cover 30, the plate spring 502 is placed on the cabinet 20, and as the cover 30 is rotated in the closed direction, the pin 501 forwardly presses the plate spring 502, whereby buffering force against the rotation of the cover 30 in the closed direction is produced. Therefore, when the force attempting to rotate the cover 30 in the closed direction under its own weight and that of the buffering force against the rotation of the cover 30 in the closed direction are balanced, the rotation of the cover 30 in the closed direction stops and the cover 30 can be prevented from being closed.

For the printer 10 to print on the slipsheet S without problems, it is necessary to hold the slipsheet entry face 31 horizontal, namely, to close the cover 30 completely. Therefore, if the cover 30 is not completely closed, printing on the slipsheet S is preferably not executed.

Figure 8:
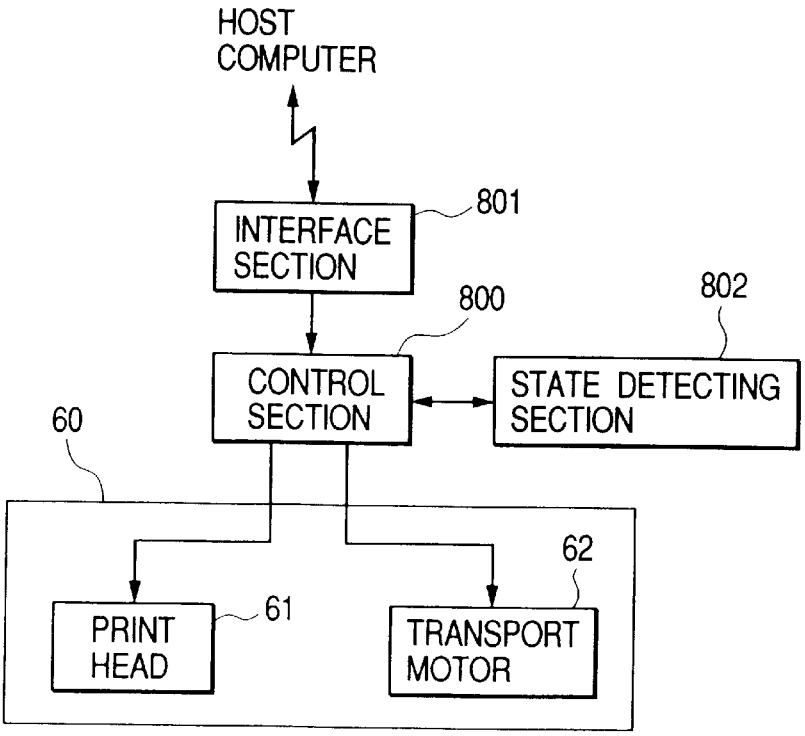
FIG. 8 is a block diagram concerning control of printing on a slipsheet.

FIG. 8 is a block diagram concerning control of printing on a slipsheet. In the figure, a control section 800 controls communications with the host computer through an interface section 801. The control section 800 also analyzes various instructions transmitted from the host computer and performs the whole control of the printer 10. Specifically, upon reception of a slipsheet print instruction from the host computer, the control section 800: instructs a state detecting section 802 (described later) to detect the open/closed state of the cover 30; and controls the operation of the print head 61, and transport motor 62, in the slipsheet print section 60.

The control section 800 is generally made up of a CPU and ROM, RAM, and logic circuits of gate arrays, etc., required for the operation of the CPU. Processing in the control section (described later) is performed based on a control program stored in the ROM. Of course, EEPROM, flash RAM, etc., can be used in place of the ROM. The control program can also be loaded into the RAM for execution, in which case any information record medium can be used as the source of the control program and, in addition, the control program can be loaded via WAN of the Internet, etc., or LAN.

The state detecting section 802 is a functional block for detecting the state of each section of the printer; for example, it detects the open/closed state of the cover 30 and the presence or absence of a slipsheet. Therefore, the detecting section 802 includes the above-described cover state detector, slipsheet detector 63, etc. The cover state detector is installed at such a position where light from the light emitting section is blocked by the member 40*c* of the cover 30, so that light does not reach the light receiving section, only if the cover 30 is locked to the cabinet 20 and is completely closed. Thus, when the light receiving section detects light from the light emitting section, the state detecting section 802 can detect the open state of the cover 30; when the light receiving section does not detect light from the light emitting section, the state detecting section 802 can detect the closed state of the cover 30.

Figure 9:
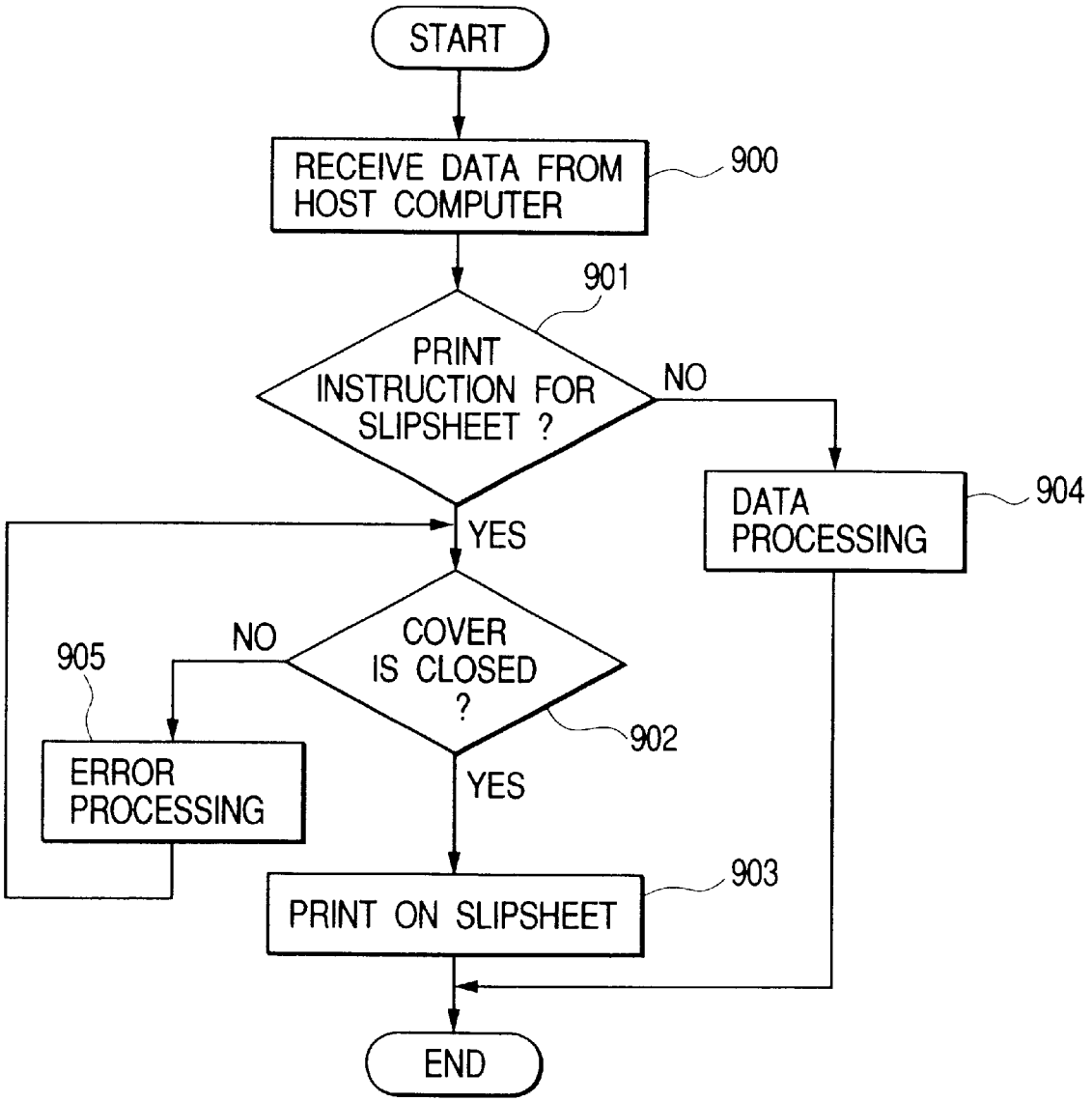
FIG. 9 is a flowchart of processing performed when a slipsheet print instruction is transmitted from a host computer.

FIG. 9 is a flowchart of processing performed when a slipsheet print instruction is transmitted from the host computer. Upon reception of data from the host computer (step 900), the control section 800 analyzes the contents of the data and determines whether or not the data is a slipsheet print instruction (step 901). If the data is not a slipsheet print instruction, the control section 800 performs predetermined data processing (step 904) and terminates the routine.

If the data is a slipsheet print instruction, the control section 800 determines whether or not the cover 30 is closed (step 902). Specifically, the control section 800 sends an instruction for detecting the open or closed state of the cover 30 to the state detecting section 802. For example, the control section 800 supplies an electric current to the LED of the transmission-type photosensor. The state detecting section 802 checks the light receiving section of the internal photosensor for a light receiving state. If the light receiving section receives light from the light transmission section, the state detecting section 802 detects that the cover 30 is open; if the light receiving section does not receive light from the light transmission section, the state detecting section 802 detects that the cover 30 is closed. Then, the state detecting section 802 sends the detection result to the control section 800, which then determines whether or not the cover 30 is closed based on the detection result sent from the state detecting section 802.

If the control section 800 determines that the cover 30 is closed, it controls the operation of the print head 61 and the transport motor 62 based on the print instruction sent from the host computer to print on a slipsheet S (step 903).

On the other hand, if the cover 30 is open, the control section 800 performs predetermined error processing of blinking an error indication LED placed in the switch panel 11, etc., for example, (step 905) until the cover 30 is detected as being closed.

Thus, if the cover 30 is not completely closed, printing on the slipsheet S is not executed, whereby a print failure caused by the fact that the slipsheet entry face 31 on the top of the cover 30 is not horizontal can be prevented.

Figure 10:
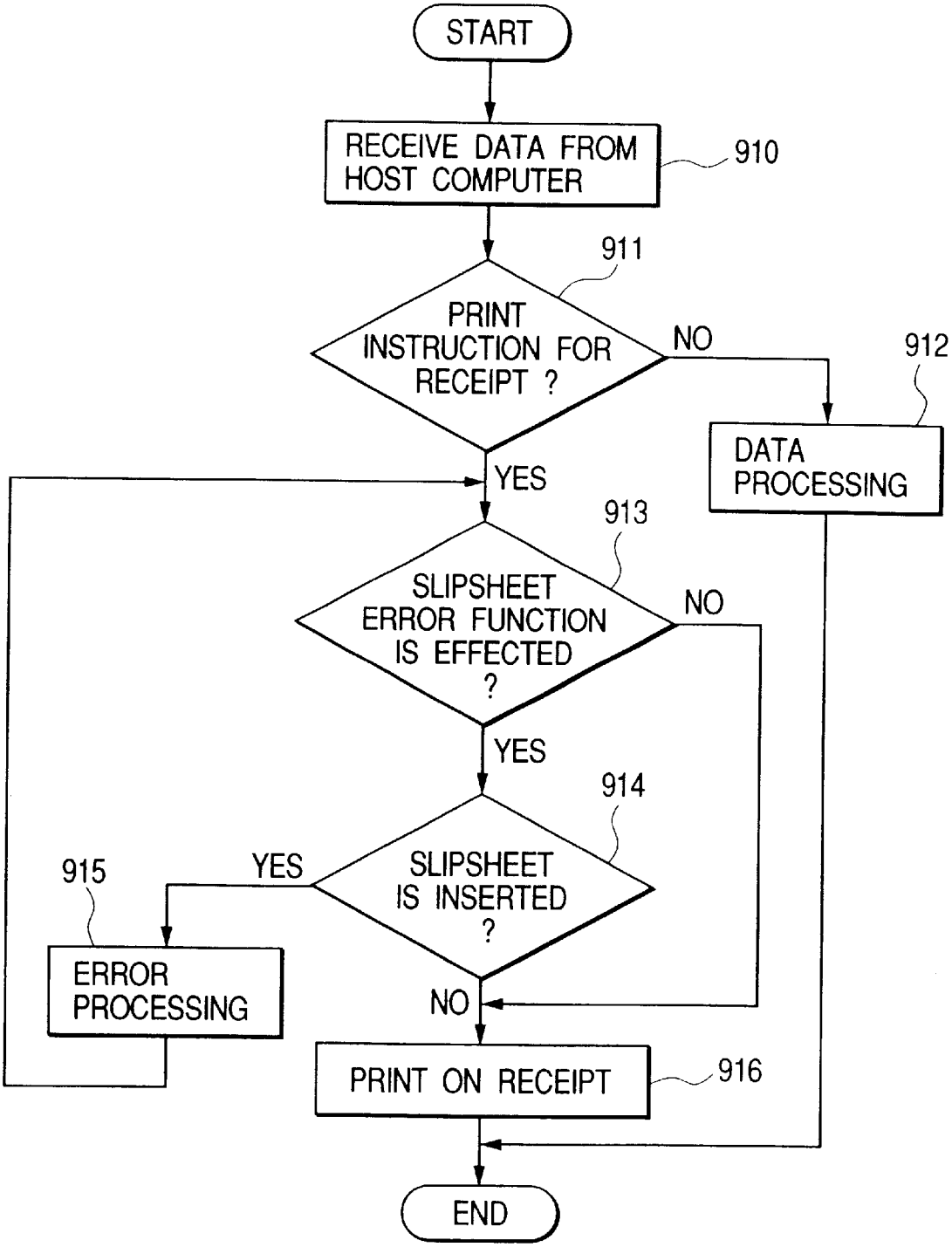
FIG. 10 is a flowchart of processing performed when a receipt print instruction is transmitted from a host computer.
Figure 11:
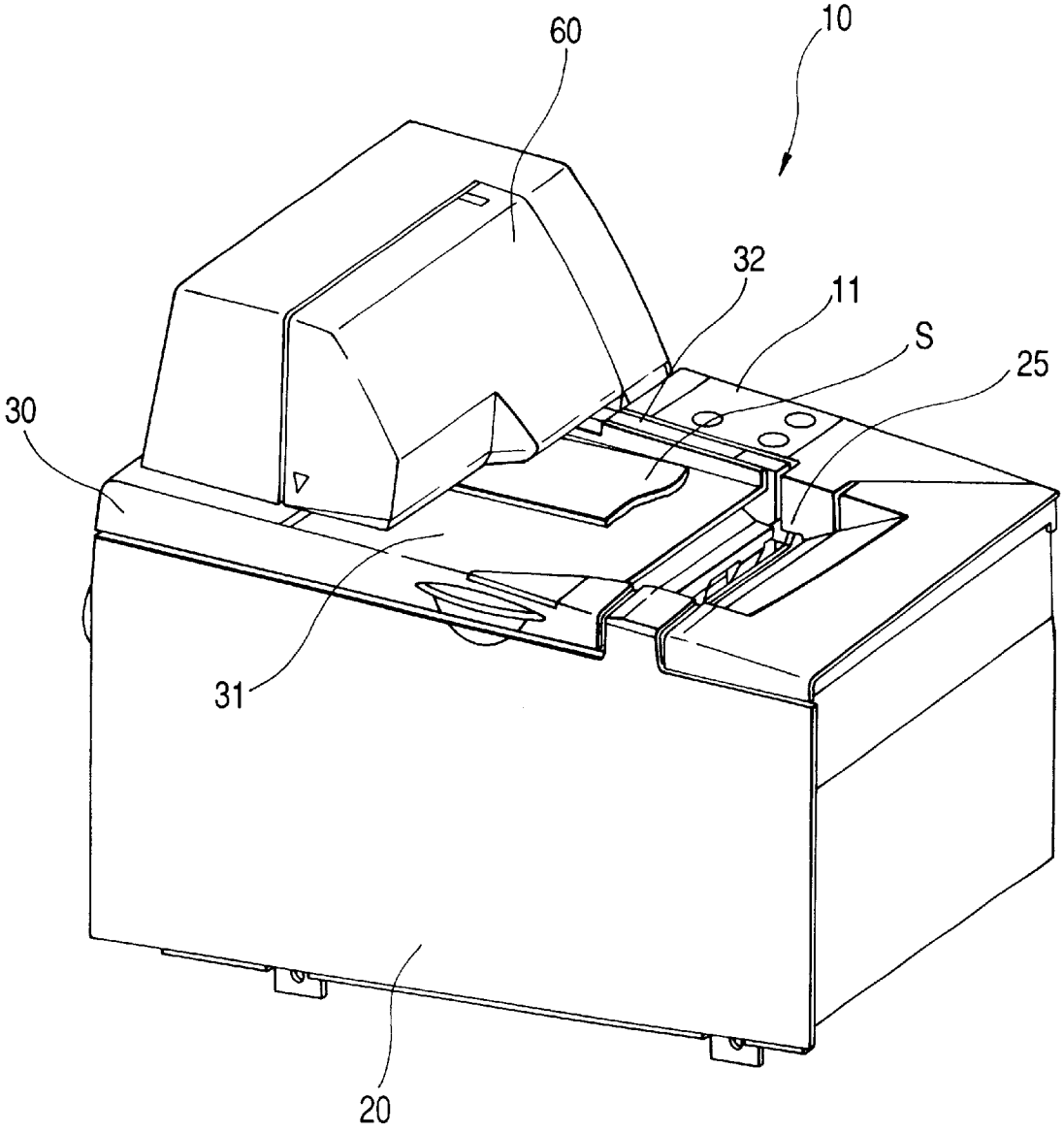
FIG. 11 is an external perspective view of a printer according to a second embodiment of the invention when its cover is closed.

FIG. 10 is a control flowchart for using the rolled paper Print section to print a receipt. Upon reception of data from a host, such as the host computer or a POS terminal (step 910), the data is analyzed to determine whether or not the data is a receipt print instruction (step 911). The data received from the host may be once stored in an FIFO reception buffer. The receipt print instruction may consist of a "receipt selection command" followed by "print data."

If the data is not a receipt print instruction, control goes to step 912 and the data is analyzed and processed. A detailed description will not be given.

On the other hand, if the data is a receipt print instruction, it is determined whether or not a "slipsheet error function" (described just below) is selected (step 913). If a slipsheet is detected, there is probability that the slipsheet may cover and block the discharge slot of a receipt (rolled paper). Thus, the slipsheet error function is a function for skipping printing on the receipt to avoid a paper jam of the receipt caused by a slipsheet covering and blocking the discharge slot. However, for example, if the length of the receipt to be printed is sufficiently short, a paper jam does not occur even though a slipsheet exists. Thus, the slipsheet error function is not necessary depending on the application, and skipping printing on the receipt may result in degradation of the processing efficiency. Therefore, in the example, the slipsheet error function can be set to selection (disable) or non-selection (enable) in response to a predetermined command from the host. The slipsheet error function setup state is stored in the RAM, etc., and is referenced at the determination time (step 913). If the slipsheet error function is set to non-selection (enable), receipt printing is executed at step 916 regardless of whether or not a slipsheet exists.

On the other hand, if the function is set to selection (disable), it is then determined whether or not a slipsheet is set in the slipsheet print section (step 914) based on information from the slipsheet detector 63. If a slipsheet is detected, receipt printing is not executed, and the operator is prompted—by error processing such as blinking of the error indication LED placed in the switch panel 11, etc., for example, (step 915)—to remove the slipsheet. It is desirable that the error state should be sent to the host by using an automatic status transmission function, etc., for example. If a slipsheet is not detected, receipt printing is executed (step 916).

FIGS. 11 to 14 show a printer according to a second embodiment of the invention. Parts identical with, or similar to, those previously described with reference to FIGS. 1 to 10 are denoted by the same reference numerals in FIGS. 11 to 16 and will not be discussed again. This embodiment is provided by further improving the first embodiment in view of mass productivity, etc. The main improvements are as follows:

First, the positions of the printer switches operated by the operator are changed. That is, in the first embodiment, the switch panel comprising the switches is placed on the top of the slipsheet print section 60; in this embodiment, a switch panel is placed on the side of a cabinet 20 and at the right of a cover 30 to improve ease of operation. Thus, if the cover 30 is open, switches can be easily operated; for example, test print of a slipsheet print section 60 during roll paper replacement, etc., can be executed easily.

Figure 12:
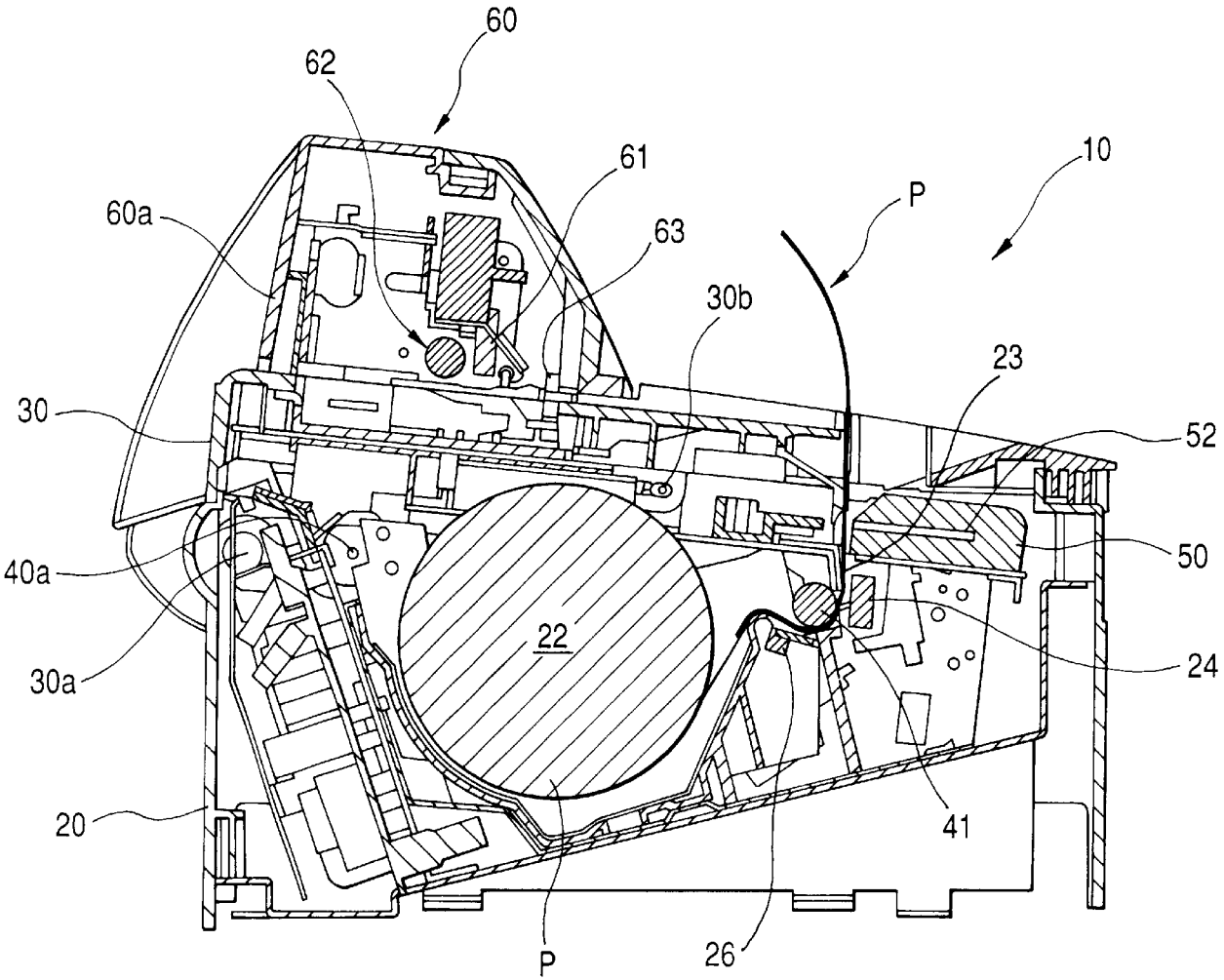
FIG. 12 is a sectional side view of the printer according to the second embodiment of the invention when its cover is closed.
Figure 13:
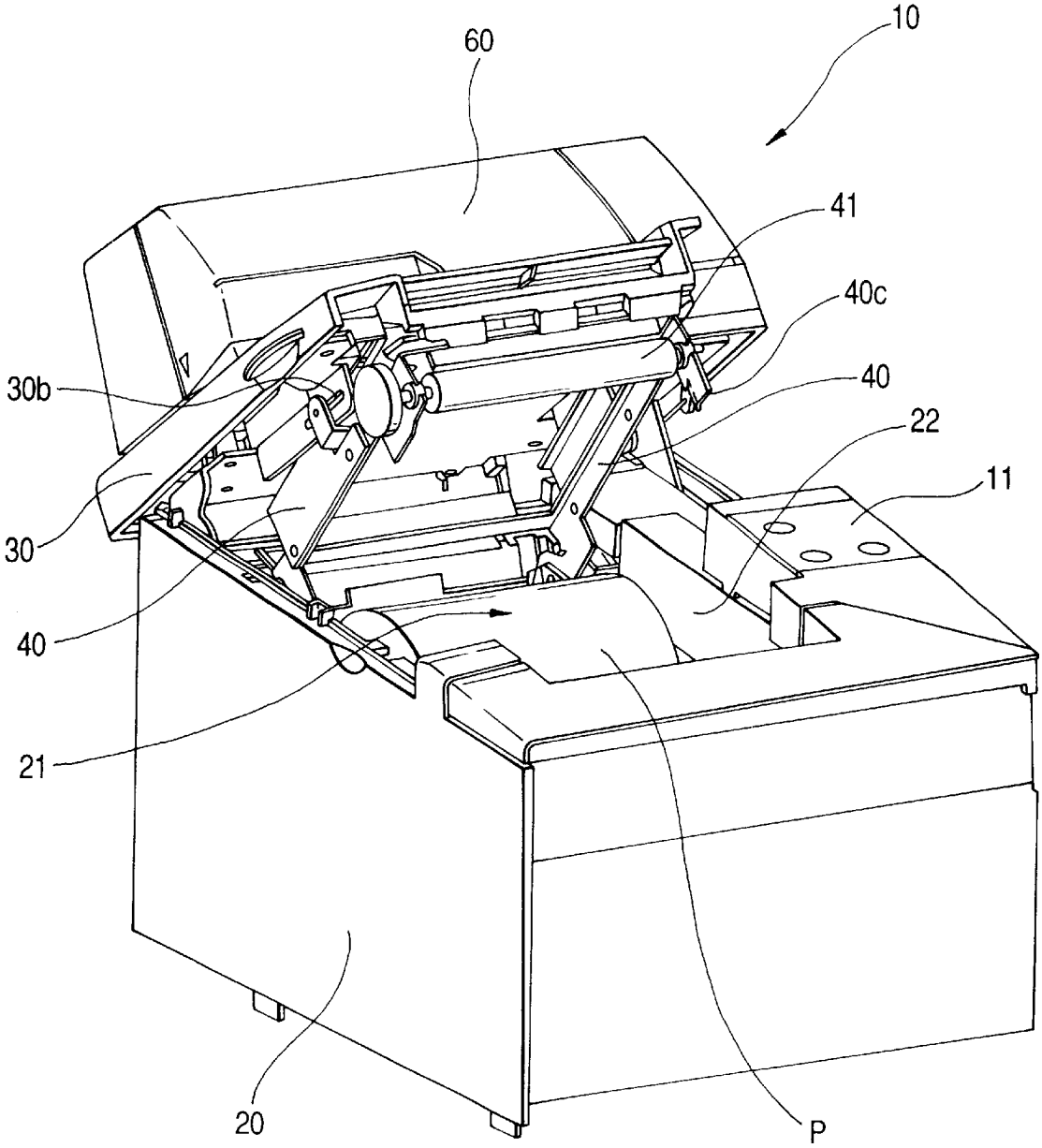
FIG. 13 is an external perspective view of the printer according to the second embodiment of the invention when its cover is opened.
Figure 14:
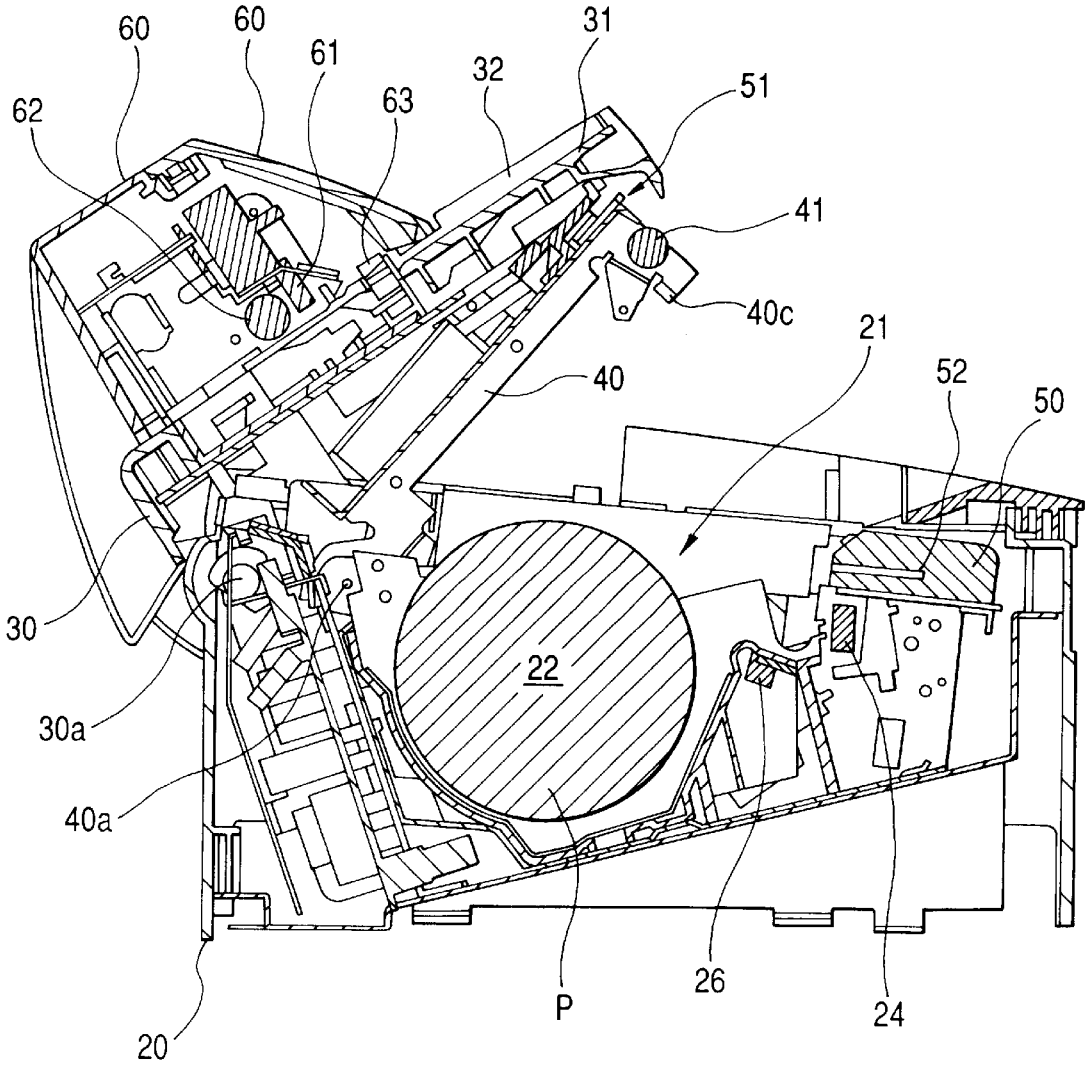
FIG. 14 is a sectional side view of the printer according to the second embodiment of the invention when its cover is opened.

Next, the position of the rolled paper print head 24 is changed. That is, in the first embodiment, as shown in FIGS. 2 and 4, the print head 24 is placed with the print element placement face (print face) upward so that the platen 41 abuts on the print head 24 from above; in this embodiment, as shown in FIGS. 12 and 14, a print face is placed on the side of a print head to bring the print position and the cut position of a cutter as close to each other as possible, whereby it is possible to lessen the distance between the print position and the cut position. Due to such an arrangement, rolled paper is more efficiently used.

Figure 15:
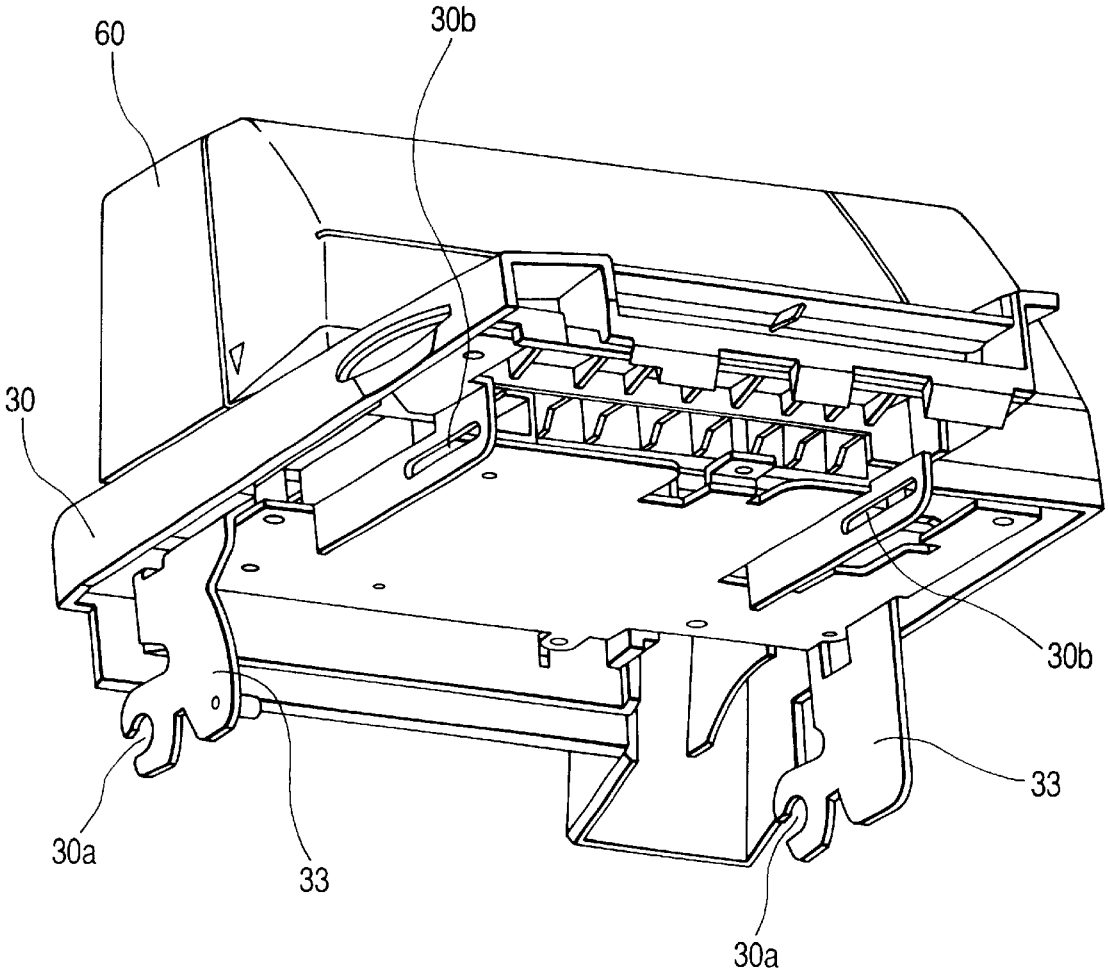
FIG. 15 is a fragmentary perspective view of the printer according to the embodiments of the invention.

FIGS. 15 and 16 are perspective views showing the components of the printer of the above embodiments. FIG. 15 shows a unit of the cover 30 fixed to connection frame 33. The slipsheet print section 60 is placed in the cover unit 30 which is rotated on a fulcrum 30*a* and is opened relative to the cabinet 20. FIG. 16 shows an arm member 40 subassembly. A platen 41 and a fixed blade 51 are attached to arm members 40.

Although the invention has been described in its preferred embodiments with reference to the accompanying drawings, the invention is not limited to the specific embodiments, and those skilled in the art would readily recognize changes and modifications based on the claims, the detailed description of the invention, and the known arts, which changes are within the scope of this invention as defined in the appended claims.

For example, in the above embodiments, the cover 30 is formed with the slot 30*b* and the arm member 40 is formed with the support shaft 40*b*. But the cover may be formed with the support shaft and the arm member may be formed with the slot. For example, the cover and the arm members may be joined by springs, etc., so that the rotation of the arm members is associated with the opening or closing operation of the cover.

In the above embodiments, the fixed blade 51 is placed on the arm members 40 whereas the moving blade 52 is placed in the cabinet 20. But the moving blade, may be placed on the arm members and the fixed blade may be placed in the cabinet. Although the slipsheet entry face 31 of the cover 30 is formed in one side margin with the slipsheet guide 32, the entry opening 21 of the cabinet 20 may be formed in one side margin with the slipsheet guide 32.

The printer 10 is a printer capable of printing on both rolled paper P and slipsheets S, but the invention can also be applied to a printer for printing on continuous paper other than rolled paper.

What is claimed is:

1. A printer, for printing on both continuous paper and a slipsheet, comprising:

a cabinet for accommodating the continuous paper which is entered from an entry opening provided in a top face of the cabinet;

a first print section, provided in the cabinet, for printing on the accommodated continuous paper;

a cover having a rear end portion, said rear end portion is pivotably supported by the cabinet so that said cover opens and closes the entry opening;

a discharge slot defined between the cabinet and a front end portion of the cover when the cover is closed, wherein said discharge slot is adapted to discharge the continuous paper from said printer;

an entry face provided as a front top face of the cover, to which the slipsheet is inserted; and a second print section provided in an upper rear portion of the cover, wherein said second print section is adapted to print the slipsheet inserted in the entry face.

2. The printer as set forth in claim 1, wherein the discharge port is placed at a position lower than that of the entry face.

3. The printer as set forth in claim 1, further comprising a guide member provided in either the cover or the cabinet, for defining a widthwise position of a slipsheet.

4. The printer as set forth in claim 1, further comprising a buffer member for buffering against the closing movement of the cover due to its own weight.

5. The printer as set forth in claim 1, further comprising:

a cover state detector for detecting whether the cover is opened; and a controller for disabling the printing a slipsheet when the cover state detector detects that the cover is opened.

6. A printer, for printing on continuous paper, comprising:

a cabinet provided with an entry opening through which continuous paper may be entered into the cabinet;

a first print head, provided in the cabinet, for printing on continuous paper;

a cover pivotably supported at a first position of the cabinet so as to open/close the entry opening;

a frame member supported at a second position of the cabinet and connected to the cover so as to be movable thereon;

a discharge slot, defined between one end portion of the cover and the cabinet when the cover is closed, through which the continuous paper may be discharged from the printer; and a first cutter blade supported by the frame member and situated so as to cut continuous paper at the discharge slot when the cover is closed, wherein a distance between the end portion of the cover and a blade edge of the first cutter blade when the cover is opened is larger than a distance therebetween when the cover is closed.

7. The printer as set forth in claim 6, further comprising a second cutter blade, provided in the cabinet, which is to be crossed with the first cutter blade to cut continuous paper when the cover is closed.

8. The printer as set forth in claim 7, further comprising a driver, provided in the cabinet, for moving the second cutter blade so as to cross with the first cutter blade.

9. The printer as set forth in claim 6, further comprising a connecting member for connecting the cover and the frame member so as to be movable with each other.

10. The printer as set forth in claim 9, wherein the connecting member includes a slot provided in one of the cover and the frame member, and a support shaft provided in the other so as to be slidable within the slot.

11. The printer as set forth in claim 6, further comprising a platen supported by the frame member, wherein continuous paper is sandwiched between the platen and the first print head.

12. The printer as set forth in claim 6, wherein a pivotal path of the first cutter blade is situated inward of a pivotal path of the end portion of the cover.

13. The printer as set forth in claim 6, further comprising a second print head, provided in the cover, for printing on a slipsheet.

14. A printer, for printing on continuous paper, comprising:

a cabinet provided with an entry opening through which continuous paper may be entered into the cabinet;

a first print head, provided in the cabinet, for printing on continuous paper;

a cover pivotably supported at a first position of the cabinet so as to open/close the entry opening;

a frame member supported at a second position of the cabinet and connected to the cover so as to be movable thereon;

a discharge slot, defined between one end portion of the cover and the cabinet when the cover is closed, through which continuous paper may be discharged from the printer; and a first cutter blade supported by the frame member and situated so as to cut continuous paper at the discharge slot when the cover is closed, wherein a distance between a bottom face of the cover and a blade edge of the first cutter blade when the cover is closed is smaller than a distance therebetween when the cover is opened.

15. The printer as set forth in claim 14, further comprising a second cutter blade, provided in the cabinet, which is to be crossed with the first cutter blade to cut continuous paper when the cover is closed.

16. The printer as set forth in claim 15, further comprising a driver, provided in the cabinet, for moving the second cutter blade so as to cross with the first cutter blade.

17. The printer as set forth in claim 14, further comprising a connecting member for connecting the cover and the frame member so as to be movable with each other.

18. The printer as set forth in claim 17, wherein the connecting member includes a slot provided in one of the cover and the frame member, and a support shaft provided in the other so as to be slidable within the slot.

19. The printer as set forth in claim 14, further comprising a platen supported by the frame member, wherein continuous paper is sandwiched between the platen and the first print head.

20. The printer as set forth in claim 14, wherein a pivotal path of the first cutter blade is situated inward of a pivotal path of the end portion of the cover.

21. The printer as set forth in claim 14, further comprising a second print head, provided in the cover, for printing on a slipsheet.

22. A printer, for printing on continuous paper, comprising:

a cabinet provided with an entry opening through which continuous paper may be entered into the cabinet;

a first print head, provided in the cabinet, for printing on continuous paper;

a cover pivotably supported at a first position of the cabinet so as to open/close the entry opening;

a frame member supported at a second position of the cabinet and connected to the cover so as to be movable thereon;

a discharge slot, defined between one end portion of the cover and the cabinet when the cover is closed, through which the continuous paper may be discharged from the printer; and a first cutter blade supported by the frame member and situated so as to cut continuous paper at the discharge slot when the cover is closed, wherein a blade edge of the first cutter blade is housed in the cover when the cover is opened.

23. The printer as set forth in claim 22, further comprising a second cutter blade, provided in the cabinet, which is to be crossed with the first cutter blade to cut continuous paper when the cover is closed.

24. The printer as set forth in claim 23, further comprising a driver, provided in the cabinet, for moving the second cutter blade so as to cross with the first cutter blade.

25. The printer as set forth in claim 22, further comprising a connecting member for connecting the cover and the frame member so as to be movable with each other.

26. The printer as set forth in claim 25, wherein the connecting member includes a slot provided in one of the cover and the frame member, and a support shaft provided in the other so as to be slidable within the slot.

27. The printer as set forth in claim 22, further comprising a platen supported by the frame member, wherein continuous paper is sandwiched between the platen and the first print head.

28. The printer as set forth in claim 22, wherein a pivotal path of the first cutter blade is situated inward of a pivotal path of the end portion of the cover.

29. The printer as set forth in claim 22, further comprising a second print head, provided in the cover, for printing on a slipsheet.

* * * * *

UNITED STATES PATENT AND TRADEMARK OFFICE

CERTIFICATE OF CORRECTION

PATENT NO. : 6,443,645 B1
DATED : September 3, 2002
INVENTOR(S) : Takei et al.

It is certified that error appears in the above-identified patent and that said Letters Patent is hereby corrected as shown below:

Title page,
Please insert:

-- [30] Foreign Application Priority Data

March 30, 2000 [JP] 2000-095702

March 30, 2000 [JP] 2000-095703 --.

Signed and Sealed this

Seventh Day of January, 2003

JAMES E. ROGAN
*Director of the United States Patent and Trademark Office*